US009464509B2

(12) United States Patent
Kroll et al.

(10) Patent No.: US 9,464,509 B2
(45) Date of Patent: Oct. 11, 2016

(54) DRIPPING OFF MAT

(76) Inventors: Timm Kroll, Unna (DE); Peter Kroll, Houston, TX (US)

( * ) Notice: Subject to any disclaimer, the term of this patent is extended or adjusted under 35 U.S.C. 154(b) by 0 days.

(21) Appl. No.: 13/381,222

(22) PCT Filed: Jul. 1, 2010

(86) PCT No.: PCT/EP2010/003917

§ 371 (c)(1),
(2), (4) Date: Jun. 25, 2012

(87) PCT Pub. No.: WO2011/000534

PCT Pub. Date: Jan. 6, 2011

(65) Prior Publication Data

US 2012/0258267 A1 Oct. 11, 2012

(30) Foreign Application Priority Data

Jul. 2, 2009 (DE) ..... 20 2009 009 082 U

(51) Int. Cl.
*E04C 2/42* (2006.01)
*E21B 41/00* (2006.01)

(52) U.S. Cl.
CPC ..... *E21B 41/00* (2013.01); *Y10T 428/13* (2015.01); *Y10T 428/1352* (2015.01)

(58) Field of Classification Search
CPC ..... B65D 2519/00412; B65D 19/0016; E21B 41/00; Y10T 428/1352; Y10T 428/13
USPC ..... 52/660, 664, 668, 669, 667; 206/386, 206/396
See application file for complete search history.

(56) References Cited

U.S. PATENT DOCUMENTS

| | | | | | |
|---|---|---|---|---|---|
| 254,688 | A | * | 3/1882 | Parkison | 126/167 |
| 2,437,186 | A | * | 3/1948 | Collins | 52/667 |
| 3,308,594 | A | * | 3/1967 | Ashworth | 52/507 |
| 4,348,987 | A | * | 9/1982 | Herring | 119/509 |
| 4,785,604 | A | * | 11/1988 | Johnson, Jr. | 52/668 |
| 4,869,163 | A | * | 9/1989 | Haskins | 99/482 |
| 4,928,471 | A | * | 5/1990 | Bartley | 52/664 |
| 5,020,667 | A | * | 6/1991 | Bush | 206/386 |
| 5,092,251 | A | * | 3/1992 | Hamaker et al. | 108/57.13 |
| 5,254,798 | A | * | 10/1993 | Zoback | 588/259 |
| 5,307,931 | A | * | 5/1994 | Gillispie et al. | 206/386 |
| 5,538,128 | A | * | 7/1996 | Stierll et al. | 198/773 |
| 5,562,047 | A | * | 10/1996 | Forney et al. | 108/57.13 |
| 5,797,236 | A | * | 8/1998 | Posey et al. | 52/664 |
| 6,113,174 | A | * | 9/2000 | McPherson | 296/26.15 |
| 6,321,499 | B1 | * | 11/2001 | Chuang | 52/480 |

* cited by examiner

*Primary Examiner* — Basil Katcheves
(74) *Attorney, Agent, or Firm* — Bushman Werner, P.C.

(57) ABSTRACT

The invention relates to a drip mat for equipment such as drill rods, drill pipes, and accessories therefor. The drip mat comprises several components, such as a flat base plate, one or more bounding webs surrounding the base plate at the edges thereof, which bounding webs together with the base plate form a container that is open at the top, wherein the bounding webs are provided in some areas with slot-shaped recesses that are open at the top.

8 Claims, 3 Drawing Sheets

DRIPPING OFF MAT

Figure 1:
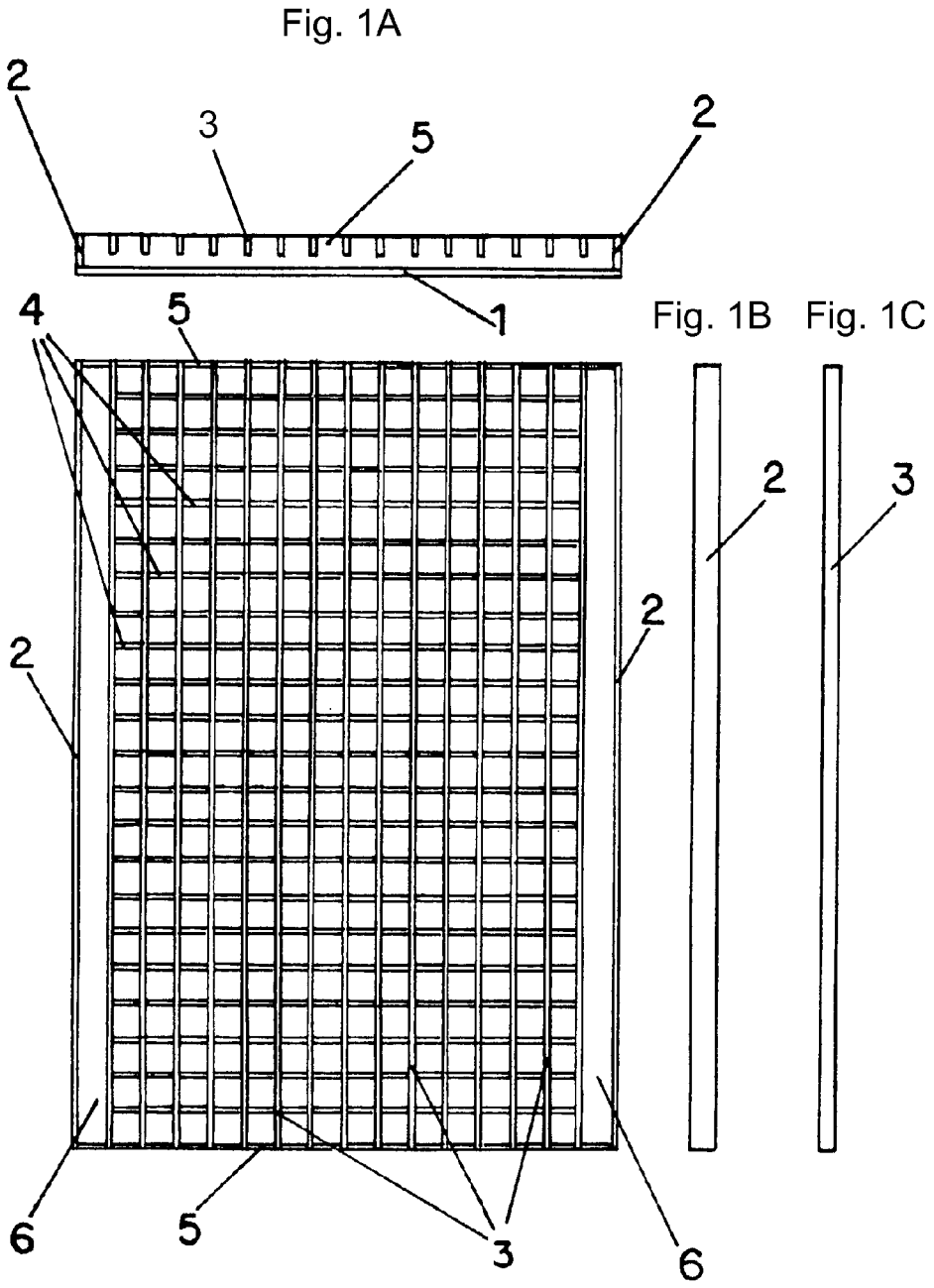

The invention relates to a drip mat, referred to in English-speaking world as "mud mat" for equipment such as drill pipe, drill pipe and accessories thereto.

Such drill pipe, drill pipe and accessories for oil or gas wells on land and on oil rigs used in the sea to the equipment briefly stored after use, thus adhering mud, ie oil, natural gas or rock groups or additional funds from the drilling operations take place, etc. and can drain.

In the prior art are latticed drip mat known.

The mats must be made very stable, so that they use in harsh conditions on oil rigs or drilling on land stood a while to keep.

In general, the grid-shaped drip mat is made from wood.

The disadvantage here is firstly the requirement that the grid-like mats, the amount of the accumulated drilling mud record often can not and thus the storage place is dirty, that they are difficult to clean and that because of its durability here often-used tropical timber in ecological terms is not acceptable is.

The innovation was therefore the object of avoiding these drawbacks and to provide an easily cleanable, durable, easy to produce Drip mat, which has a high absorption capacity for drilling mud.

This object is achieved by the features of the main claim.

Further advantageous embodiments are disclosed in the subclaims.

Here, the renewal according drip mat for drill pipes and tubes of several components, namely first a flat base plate, continue one or more of the base plate at its edges surrounding boundary ridges that form the base plate an open top container in which the boundary lands in some areas with slit-shaped recesses are provided with upwardly open, so that they get a comb-like appearance.

Furthermore, the drip mat on several over the surface of the base plate distributed holding webs, which are provided with a slit-shaped upwardly open recesses so that the retaining bars look like a comb.

Finally, the drip mat contains several footbridges that are in the slot-shaped recesses inserted upwardly open the limitation of bridges and retaining bars so that between the bridge piers and the base plate keeping a distance.

This gives a number of rectified through the support webs—and of course at the edges by the boundary bridges—channels formed above the base plate from which the drilling fluid can flow easily directed and can be rinsed out very easily with a hot steamer.

The channels are covered by the limitation of bridges, footbridges and retaining bars also formed above the grid channels, so that renewal in accordance with the equipment can drain through the mesh and the drilling mud through the channels can be removed or expires.

The depth of the slot-shaped upwardly open recesses of limitation bars and retaining bars are generally sufficient to half the height of the boundary bridges or retaining bars, but can also adjust the slit-shaped in each case in which are formed upwardly open recesses engaging footbridges different.

It is important that sufficient distance between the bridge piers and the base plate to ensure a safe draining of the amount of drilling mud and a light rinse.

An advantageous embodiment is that the base plate is rectangular, with the drip mat has at its head sides a limit web, which is provided with slit-shaped upwardly open recesses and on their longitudinal sides each having a boundary bridge that formed without recesses is.

This allows for simplified manufacturing and again by any unidirectional channels and is responsible for transportation to the application and adapt easily to the drill site.

Another advantageous embodiment consists in that the retaining bars parallel to the sides of the head, ie parallel to the ribs and the head-side boundary-bridges in parallel to the longitudinal sides, that are arranged along the side boundary ridges.

This also simplifies the manufacturing and construction and also creates a grid-like and stable structure.

Another advantageous embodiment consists in that the retaining bars are positioned and footbridges in only one portion of the base plate.

So that no one part of the area drip mat remain free of the base plate components arranged so that a kind of "melting pot" is created in which the leaking equipment collected from the mud and from which it can be flushed out later.

A further advantageous development is that the base plate, limit bars, grab bars and footbridges made of plastic.

This protects the wood previously used resources and leads to strength and durability of Drip mat can be adjusted within wide limits.

A further advantageous development is that in an embodiment are made of plastic, the base plate, limit bars, grab bars and footbridges at least partially welded together.

This simplifies the production and increases the strength of the mat.

A further advantageous development is that limitation bars, grab bars and footbridges are at least partially screwed together.

Also, this will increase your strength.

A further advantageous development is that some or even all the support webs in their orientation, with the slit-shaped upwardly open recesses provided the area with the longer-end of the retaining bars long screw with inlaid footbridges are screwed.

This is the life and durability of the drip mat increases while maintaining their flexibility.

According to one embodiment of the invention will be explained in more detail.

Shown

FIG. 1 shows an overall view of the according drip mat from above, with base plate, limiting support webs and footbridges. FIG. 1A shows an end view of FIG. 1. FIG. 1B shows a side elevational view of one of the boundary ridges 2. FIG. 1C shows a side elevational view of one of the footbridges 3.

Figure 2:
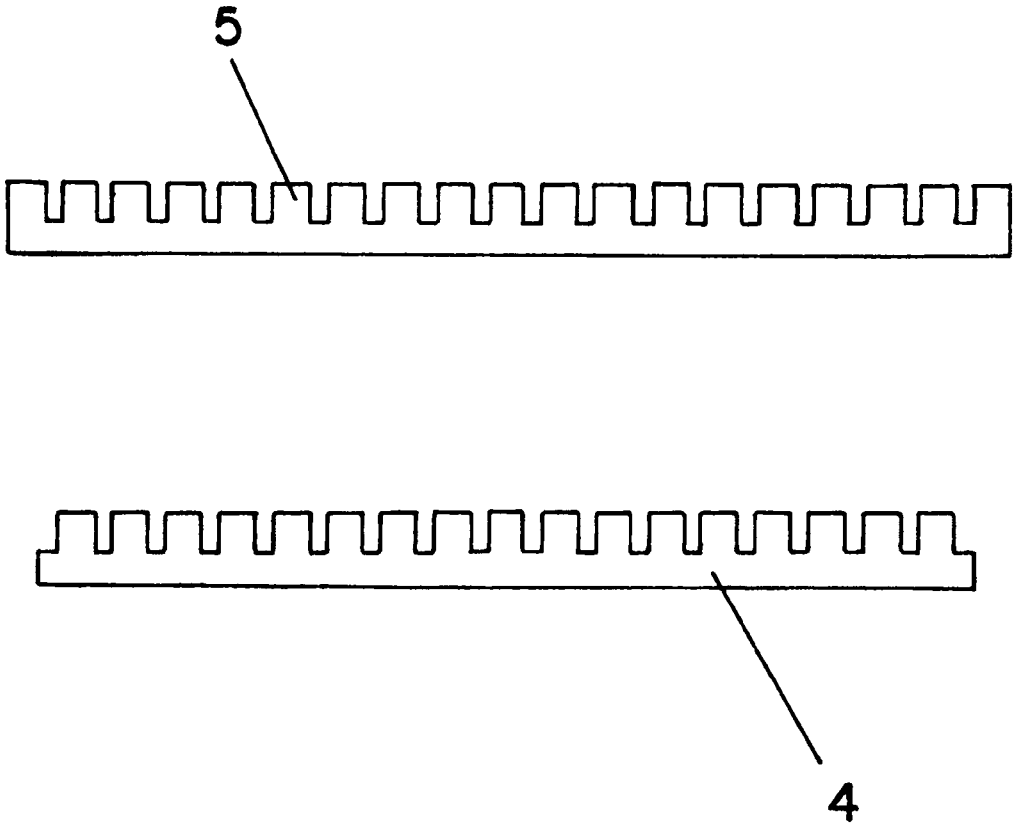
Figure 3:
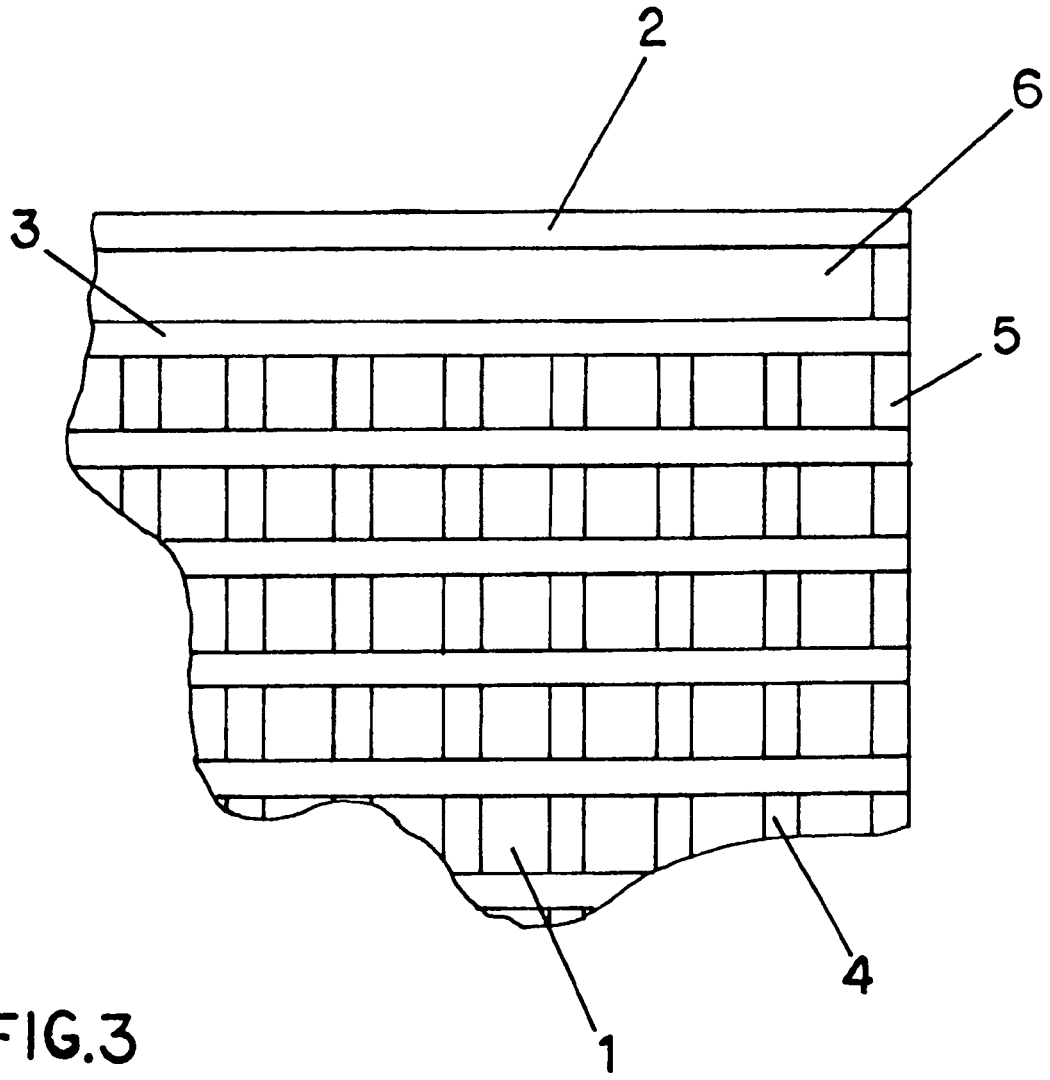

FIG. 2 is a limitation of the bridge and a retaining bar according drip mat renewal as individual parts, FIG. 3 is a detail view of a corner of renewal according drip mat.

The FIG. 1 shows an overall view of the renewal according drip mat rectangular from above, with a base plate, the head-side boundary webs 5 and along the side boundary webs 2.

Also shown are the retaining bars 4 and the 3-bridges, which are drawn here for simplicity, only some of the support webs and webs of the bridge with the reference numerals 3 and 4.

The head-side boundary webs 5 and the retaining bars 4 are provided with upwardly open recesses schlitzfömigen.

In the right part of FIG. 1 shows a drawing properly folded to the right view of the bars 2 and 5 and the base plate 1 of drip mat.

In the lower part of the drawing of FIG. 1 are shown a drawing properly folded down view of the webs 2 and 3 of the support webs drip mat.

FIG. 2 shows a head-side boundary and a retaining bar 5 bar 4 of renewal according drip mat as individual parts in the side view.

Here we see that the support webs are shorter than the head-side support webs 4 5 formed, leaving a free on the sides of drip mat part surfaces 6 of drip mat, so that a kind of "melting pot" is created in which the leaking from the equipment drilling mud accumulates and from which it can be flushed out later.

FIG. 2 is a detail view of a corner of renewal according drip mat shows in plan view.

Also here you can see the head-side boundary ridge 5, along the side boundary webs 2, the retaining bars 4, the three footbridges and the remaining free space part 6 of renewal according drip mat, was in the corner of the mat meet.

The head-side boundary along the ridge 5 and side boundary webs 2 are [deg.] At the upper, outer surface provided with a chamfer of 45.

All items are made of plastic and are welded together.

1: base plate
2: limiting long-side bar
3: footbridge
4: holding web
5: head side boundary bridge
6: free space remaining portion

The invention claimed is:

1. A drip mat for drill pipes and tubes, comprising:

a base plate having side edges, said base plate being substantially flat throughout its entirety, an upwardly extending frame fixedly attached at the base plate side edges, said frame comprised of a first border piece, a second border piece opposite said first border piece, a first side piece, and a second side piece opposite said first side piece, said frame together with the base plate forming an open top container, a web comprised of a plurality of support bars and a plurality of bridge bars, said support bars spaced from one another and extending in a direction parallel to said first and second border pieces and fixedly attached to said base plate preventing relative movement between said support bars and said base plate, said support bars and said first and second border pieces having upwardly facing registering open recesses for receiving said bridge bars, said bridge bars extending in a second, transverse direction positioned in the recesses of the support bars and the first and second border pieces, said bridge bars having a uniform rectangular cross-section throughout and being spaced above said base plate, said support bars having a first end and a second end, said first and second ends being spaced from said first and second side pieces, respectively, the length of said support bars determining the width of said web;

said base plate, frame, support bars, and bridge bars being welded together to form a rigid unitary structure.

2. The drip mat according to claim 1, wherein the base plate is rectangular.

3. The drip mat according to claim 2, wherein the upwardly facing open recesses are along the length of the support bars.

4. The drip mat according to claim 1, with the support bars and bridge bars arranged only in a portion of the base plate.

5. The drip mat according to claim 1, wherein the base plate, boundary ridges, support bars and bridge bars are plastic.

6. The drip mat according to claim 1, wherein the bridge bars are flush with the top of the upwardly facing open recesses to form a substantially uniformly flat web.

7. A drip mat for drill pipes and tubes, comprising:

a base plate having side edges, an upwardly extending frame fixedly attached at the base plate side edges, said frame comprised of a first border piece, a second border piece opposite said first border piece, a first side piece, and a second side piece opposite said first side piece, said frame together with the base plate forming an open top container, a web comprised of a plurality of support bars and a plurality of bridge bars, said support bars spaced from one another and extending in a direction parallel to said first and second border pieces and fixedly attached to said base plate preventing relative movement between said supports bars and said base plate, said support bars and said first and second border pieces having upwardly facing registering open recesses for receiving said bridge bars, said bridge bars extending in a second, transverse direction positioned in the recesses of the support bars and the first and second border pieces, said bridge bars being spaced above said base plate, said support bars having first ends and second ends, said first and second ends being spaced from said first and second side pieces, respectively, the length of said support bars determining the width of said web;

said base plate, frame, support bars, and bridge bars being welded together to form a rigid unitary structure.

8. A drip mat for drill pipes and tubes, comprising:

a base plate having side edges, said base plate being substantially flat throughout its entirety, an upwardly extending frame fixedly attached at the base plate side edges, said frame comprised of a first border piece, a second border piece opposite said first border piece, a first side piece, and a second side piece opposite said first side piece, said frame together with the base plate forming an open top container, and a web comprised of a plurality of support bars and a plurality of bridge bars, said support bars spaced from one another and extending in a direction parallel to said first and second border pieces and fixedly attached to said base plate, said support bars and said first and second border pieces having upwardly facing registering open recesses for receiving said bridge bars, said bridge bars extending in a second, transverse direction positioned in the recesses of the support bars and the first and second border pieces, said support bars having first and second ends, said first and second ends spaced from said first and second side pieces, respectively, the length of said support bars determining the width of said web, there being channels formed between said support bars, said channels having a bottom surface formed by said base plate, said channels being in open communication with the area between said web and said first and second side pieces, said base plate, frame, support bars, and bridge bars being welded together to form a rigid unitary structure.

* * * * *